US005156289A

United States Patent [19]

Goof

[11] Patent Number: 5,156,289

[45] Date of Patent: Oct. 20, 1992

[54] CASING FOR STORING AND PROTECTING OBJECTS

[76] Inventor: Lennart S. K. Goof, 236A, Gl. Strandvej, DK-3050 Humlebaek, Denmark

[21] Appl. No.: 750,739

[22] PCT Filed: Apr. 14, 1989

[86] PCT No.: PCT/DK89/00087

§ 371 Date: Jan. 12, 1990

§ 102(e) Date: Jan. 12, 1990

[87] PCT Pub. No.: WO89/09734

PCT Pub. Date: Oct. 19, 1989

Related U.S. Application Data

[63] Continuation of Ser. No. 445,597, Jan. 12, 1990, abandoned.

[30] Foreign Application Priority Data

Apr. 15, 1988 [DK] Denmark ..... 2056/88

[51] Int. Cl.[5] ..... B65D 37/00

[52] U.S. Cl. ..... 220/23.2; 220/521; 220/531; 220/532; 206/373

[58] Field of Search ..... 206/373, 393, 620; 220/521, 523, 23.2, 532, 531

[56] References Cited

U.S. PATENT DOCUMENTS

| | | | |
|---|---|---|---|
| 2,501,270 | 3/1950 | Fleming | 206/373 |
| 2,917,216 | 12/1959 | Despires | 206/820 |
| 3,587,838 | 6/1971 | Miyada | 229/2.5 R |
| 4,320,846 | 3/1982 | Meyering | 220/23.8 |
| 4,471,573 | 9/1984 | Voges | 47/84 |
| 4,799,590 | 1/1989 | Farmann | 206/390 |

FOREIGN PATENT DOCUMENTS

| | | | |
|---|---|---|---|
| 2921440 | 12/1979 | Fed. Rep. of Germany | 206/0.83 |
| 424225 | 5/1911 | France | 206/372 |

*Primary Examiner*—Joseph Man-Fu Moy
*Attorney, Agent, or Firm*—Tilton Fallon Lungmus

[57] ABSTRACT

A casing includes a tubular wall portion of a deformation-resistant material and respective end portions. At least one longitudinal part of the wall portion is shaped as a lamellar part (12) with one longitudinal edge thereof being hinged to the remaining part of the wall portion. The best possible access to the interior of the casing will be obtained if the wall portion is assembled of several identical lamellar parts (12), so that a folding structure is provided which is also useful as a deposit and display tray.

5 Claims, 1 Drawing Sheet

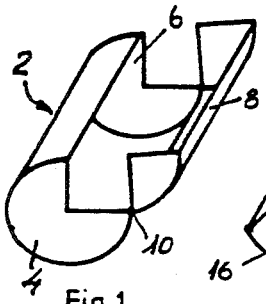
Fig.1.
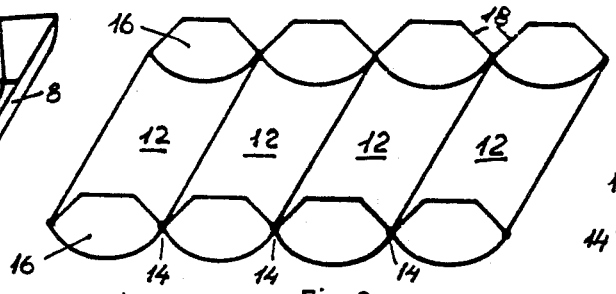
Fig.2.
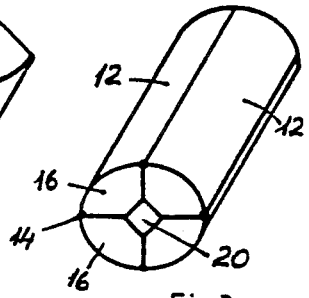
Fig.3.
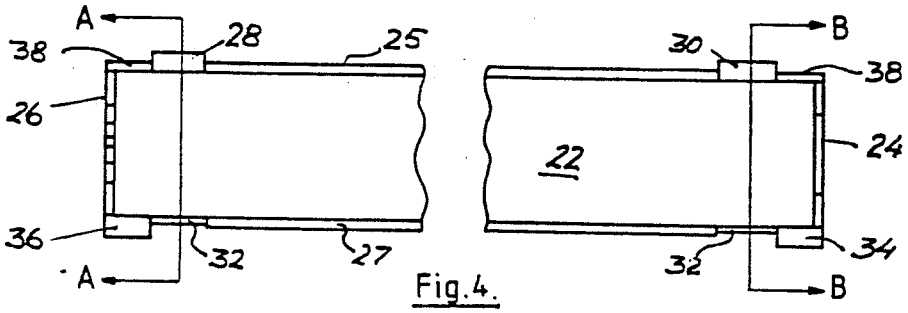
Fig.4.
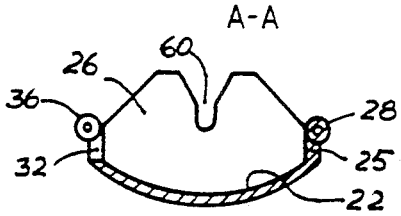
Fig. 5.
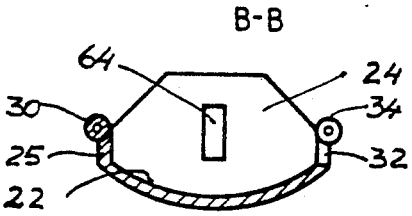
Fig. 6.
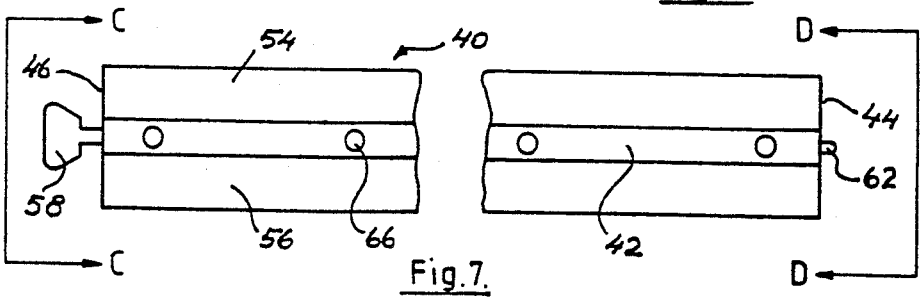
Fig.7.
Fig. 8
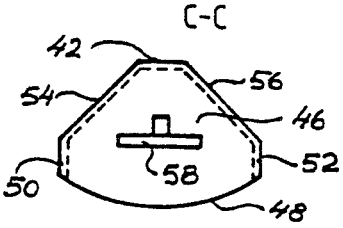
Fig.9
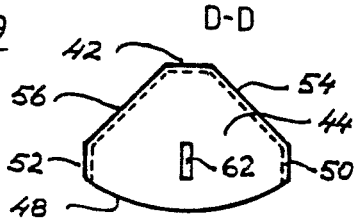

CASING FOR STORING AND PROTECTING OBJECTS

This application is a continuation of application Ser. No. 445,597, filed Jan. 12, 1990, now abandoned.

The present invention relates to a casing for storing and protecting objects. The casing is of the type which comprises a generally cylindrical and tubular wall portion made of a relatively deformation - resistant, material, and respective end portions.

Protective casings of this type are used for storing and transporting many different objects in various connections. As examples can be mentioned transport containers in pneumatic positing systems and containers for shipment and storing various types of sheet materials, such as posters and drawings.

Access to the interior of such known casings or containers takes place through removable end covers, and the putting in or taking out of sheets can be difficult, in particular in connection with larger sheet sizes.

The casing of this invention is characterized in that at least one longitudinal part of the tubular wall portion is shaped as a lamellar part with one longitudinal edge thereof being hinged to an adjacent longitudinal edge on the remaining part of the wall portion.

The hinged lamellar part can be sued as an openable lid which provides a substantially improved access to the interior of the casing, in particular when the lamellar part extends through the entire length of the casing. Thereby objects can be inserted and taken out laterally and directly. In particular it becomes substantially simpler to insert and take out more fragile objects together with appropriate filling or padding materials.

A preferred embodiment of the casing of the invention is characterized in that the tubular wall portion is composed of several longitudinal and generally identical lamellar parts which are hinged to each other in pairs along adjacent longitudinal edges in order to define a folding structure.

Access to the interior of the casing will thereby be the best possible, because the wall portion of the casing can be opened and folded out to a generally planar structure with almost free access to the inside of the unfolded wall portion. At the same time the casing will be very suitable as an exposure tray in connection with displaying as well as use of objects which have been stored in the casing. After having used the objects and casing can be closed or folded together again, and the casing can then be used for continued storing and handling of the objects.

The utility as combined storage casing and exposure tray can be further increased by associating to each lamellar part a partition insert for removable fitting to the inside of the lamellar part. Thereby objects or utensiles can be stored separately in the closed condition of the casing, and can be exposed in a well-arranged and easy accessible manner in the unfolded condition of the casing.

A special possibility of use of the casing of the invention is for use as insert or cassette in a steam sterilizer of the particular type which is disclosed in DK patent No. (application No. 5174/87.).

That particular sterilizer comprises a cylindrical steriliziation chamber in which objects, especially dental utensiles, can be placed for steam sterilization. In this connection the casing of the invention is very well-suited, in particular with appropriate partition inserts therein, because the casing is able to contain a complete set of instruments used for a standard patient treatment in a dental clinic.

Moreover, the casing of the invention is well-suited both as storage and transport container for the sterilized set of instruments and also as an exposure and deposit tray during the actual patient treatment.

In the following the casing of this invention will be further described based on embodiments and with references to the drawing in which FIG. 1 schematically shows a first embodiment of the casing of the invention;

FIG. 2 schematically shows another embodiment in its unfolded or open condition;

FIG. 3 schematically shows an embodiment as that of FIG. 2, but in the folded or closed condition thereof;

FIG. 4 is a plan view of a lamellar part for an embodiment as that of FIGS. 2 and 3;

FIGS. 5 and 6 are respective sectional views taken along A—A and along B—B in FIG. 4;

FIG. 7 is a plan view schematically showing a trough shaped partition insert for a lamellar part as that of FIG. 4;

FIGS. 8 and 9 illustrate respective end views of the partition insert in FIG. 7.

Referring now to the drawing, FIG. 1 thereof is a schematic illustration of the principle of a casing in accordance with the invention. The schematically shown embodiment has a generally cylindrical and tubular wall portion 2 with respect end portions 4, 6. As an alternative to the shown circular cross-sectional shape, the wall portion 2 may also have other cross-sectional shapes, for example elliptical or polygonal shapes.

A longitudinal part of the wall portion 2 is designed as a lamella 8 with one longitudinal edge thereof being hinged to the remaining part of the wall portion 2 as indicated at 10. Accordingly the lamella 8 is operating as an openable lid which provides free and direct access to the interior of the casing along the entire length of the casing.

In the embodiment as shown the lamella 8 makes up about one fourth of the wall portion 2. Dimensional proportions like that are beneficial, because thereby the remaining part of the wall portion 2 will be able to exert a retaining or fixing effect on rolled-up sheet materials placed therein.

FIG. 2 of the drawing is a schematic illustration of a preferred embodiment, wherein the tubular wall portion is made up of several longitudinal and preferably identical lamellar parts. These lamellar parts are hinged together two by two, such as indicated at 14. Thereby the wall portion of the casing is defining a folding structure which can be opened to define a generally planar configuration such as shown in FIG. 2. This folding structure can be closed around one or more objects which are easy to place in and to take out from the concave insides of the respective lamellar parts 12. After closing, the folding structure will be in a condition as that shown in FIG. 3.

Preferably each lamellar part has end portions 16 at the respective ends thereof. These end portions 16 which preferably are integral with the lamellar part 12, may have various shapes depending on the number of lamellar parts and the cross-sectional shape of the closed casing.

With circular cross-section of the casing, each end portion may be in the shape of a sector of a circle with a center-angle determined by the width of the lamellar part and/or by the number of lamellar parts in the wall portion of the casing. However, in order to obtain unrestricted opening and closing of the casing it is advantageous if the vertex of the circle sectors has been cut away or left out, such as it is the case in FIG. 2.

Uniform end portions similar to the end portions 16 in FIG. 2, are the preferred embodiment because, thereby, each lamellar part 12 can act as a relatively flat tray.

Regardless of the shape of the individual end portions it is, however, an advantage that edges, such as th edges 18 in FIG. 2, are designed and adapted to support against corresponding edges on adjacent end portions in the closed condition of the casing. In this way the closed casing can be made more stable as to shape. By designing the edges of the end portions in special manners it is, moreover, possible to provide openings as needed in the ends of the closed casing, for example a central opening similar to opening 20 in FIG. 3.

Reference is now made to FIGS. 4, 5 and 6 which illustrate a lamellar part similar to the parts 12 FIG. 2.

The embodiment shown has a concave inside 22 and respective end portions 24, 26 corresponding to a circle sector with center angle of 90 degrees. As indicated already, the inside 22 may also have other shapes than the shown concave surface. As examples, the inside may be plane, be made up of several plane surfaces and/or be provided with local depressions or raised areas.

Along the longitudinal edges the lamellar part includes appropriately distributed hinge means for coupling to other adjacent lamellar parts. In the embodiment shown these hinge means comprise two bulbs 28, 30 on one longitudinal edge and corresponding recesses 32 in the other longitudinal edge. At each of these recesses 32 there is moreover made a further bulb or bead 34, 36 which is arranged opposite to a corresponding recess 38 in the first longitudinal edge.

With such hinge means the bulbs 28, 30 in FIG. 4 can be inserted into the recesses 32 in another corresponding lamellar part, and at the same time the bulbs 34, 36 of the latter will be inserted into the recesses 38 in FIG. 4. In this manner respective bores in the pairs of bulbs thus provided, can be aligned and an appropriate pin or plug can be inserted through each such pair of bulbs.

The hinge means just described may also be replaced by other permanent or disconnectable hinge means. As an example the lamellar parts 12 in FIG. 2 could be permanently connected by means of special bendable folding line areas.

FIGS. 7, 8 and 9 illustrate an example of a partition insert 40 to be removably arranged on the inside 22 of the lamellar part in FIG. 4. The insert as shown is generally trough-shaped with a bottom 42, an open side, and respective end walls 44, 46. The open side which is facing downwardly in FIGS. 8 and 9, is defined at the ends thereof by a free edge 48 on the end walls 44, 46.

These free edges 48 may appropriately be adapted to the shape of the inside 22 of the lamellar part, so that the partition insert can be supported and rest on the inside 22.

For further support and guidance of the insert 40 in its associated lamellar part it is moreover advantageous that the insert has longitudinal side flange 50, 52 which fit between corresponding edge flanges 25, 27 on the lamellar part in FIG. 4.

Moreover it is advantageous that the trough-shaped portion insert 40 has two flat side walls 54, 56 which are sloping towards each other in the direction towards the bottom area 42. In the closed condition of the casing with partition inserts therein, such sloping side walls will be able to support against each other so that the partition inserts are stabilized in the closed casing.

In order to simplify the placing and removal of the partition insert in/from the opened or unfolded casing, it is advantageous that one end wall 46 includes a grip stud 58 at the outside thereof. This grip 58 may be designed with a neck which is adapted to be inserted into a slot 60 in the end portion 26. Moreover, the other end wall 44 of the partition insert may be provided with a stud 62 which can be inserted into a corresponding opening 64 in the associated end portion 24 on the lamellar part.

The grip stud 58 and the stud 62 are examples of means for releasable engagement with the end portions of a lamellar part, whereby the partition insert 40 can be stabilized and retained in a lamellar part. This is of particular importance during opening and closing of the casing.

When placing the partition insert 40 in a lamellar part of the unfolded casing, at first the end wall 44 i.e. the free edge 48 thereof, is brought to be at rest on the inside 22 while holding the partition insert 40 in an inclined position. Hereafter the inclined partition insert is to be displaced in the direction towards the end portion 24 until the stud 62 engages with the opening 64.

During this displacement it is an advantage that the lamellar part has means for guiding the partition insert. In FIG. 2 the edge flanges 25, 27 are examples of such guiding means.

After that the stud 62 has been inserted into the opening 64, the partition insert 40 is lowered in place on the inside 22, whereby the other end wall 46 is brought to be at rest on the inside 22 and at the same time the neck portion of the grip stud 58 will slide into the slot 60.

When a partition insert 40 has been brought in place in this manner, a previously placed object, such as a dental utensile, will be enclosed separately in a chamber defined by the inside 22 of the lamellar part and by the trough-shaped partition insert 40.

In an embodiment as that shown in FIG. 2, a total of four of such chambers may be provided in this manner. By omitting to place a partition insert in some of the lamellar parts it is also possible to provide for example one larger chamber (two adjacent lamellar parts without partition inserts) together with two smaller chambers defined by respective partition inserts 40.

Especially when using the casing of this invention as an insert for the chamber of a steam sterilizer, it is an advantage to define openings corresponding to the opening 20 in FIG. 3 in order to allow the best possible access for the steam to the interior of the casing.

When trough-shaped partition inserts are used in the casing it is, moreover, an advantage that the bottom 42 of the insert 40 is designed partly with appropriately distributed openings and partly in such a manner that a channel will be defined in the closed casing (FIG. 3), the channel extending through the casing and communicating with openings in the end portions of the casing.

In FIGS. 7, 8 and 9 the bottom 42 is provided with openings 66 and moreover the bottom area is flattened. With four such partition inserts in place in the casing, there will consequently be defined a centrally extending channel through the closed casing. This channel communicates with the interior of each partition insert through the opening 66, and at the ends of the channel also communicates with respective openings corresponding to the opening 20 in FIG. 3. In this manner the channel can effectively introduce and distribute steam to the interior of each partition insert.

As an alternative to removable partition inserts, one or more of the lamellar parts, for example the parts 12 in FIG. 2, could be provided with a hinged partition flap on the inside thereof. As an example, such a partition flap cold be roof-shaped and be hinged along one longitudinal edge thereof.

Moreover, one or more of the lamellar parts could be provided with a two-leaf flap structure on the inside thereof. Thus, an appropriately shaped flap cold be hinged along each of the longitudinal edges of the lamellar part, so that the two flaps thus provided, can overlap the lamellar part so as to define a underlying chamber.

As far as materials are concerned, the substantial demand is that at least the tubular wall portion with its lamellar parts in the casing should be made of a material which is relatively stable as to shape. Moreover the partition inserts, if any, should be made of a similar material.

Beyond that the choice of materials is highly determined by the planned use of the casing. Especially when the casing of the invention is to be used as insert or cassette in a steam sterilizer, the tubular wall portion of the casing as well as partition inserts, if any, should be made of materials which are able to resist the temperatures and pressures which occur in the steam sterilizer.

The planned used of the casing has also decisive influence on such factors as the number and design of the individual lamellar parts, and the number and design of partition means, if any, in the interior of the casing.

I claim:

1. A casing for storing and protecting objects, comprising a generally cylindrical and tubular body, said body including a plurality of longitudinally extending lamellar parts having adjacent longitudinal edges hinged together for relative folding movement of said lamellar parts between folded and open positions, each lamellar part having an elongated longitudinally-extending wall defining an inner surface and having end walls at opposite ends thereof, and a plurality of elongated through-shaped partition inserts, each inset having an open side defined by free edges of walls defining said through-shape of the insert, and each partition insert being adapted to be removably supported on said inner surface of a respective lamellar part with said open side facing towards said inner surface of the lamellar part and extending generally between said end walls at opposite ends thereof.

2. The casing of claim 1 in which each of said partition inserts has fee edge areas, and guiding means provided by each of said lamellar parts for guiding and holding said free edge areas of said partition inserts.

3. The casing of claim 1 in which each partition insert includes a bottom wall and a pair of flat longitudinally-extending side walls, said side walls being inclined towards each other and towards said bottom wall.

4. The casing of claim 3 in which each partition insert has a pair of longitudinal side flanges extending along said flat side walls, and each of said lamellar parts is provided with longitudinal flanges extending along and engagable with said side flanges of said partition inserts.

5. The casing of claims 1, 2, or 3 in which each partition insert includes end walls having means for releasably engaging said end walls of the associated lamellar part.

* * * * *